United States Patent [19]

Patrician et al.

[11] 4,322,248

[45] Mar. 30, 1982

[54] DOPED MOLYBDENUM-TANTALUM WIRE AND METHOD FOR MAKING

[75] Inventors: Thomas J. Patrician, Monroeton; James A. Mullendore, Towanda; Theodore L. Weaver, Troy; Clayton D. Charlesworth, Towanda, all of Pa.

[73] Assignee: GTE Products Corporation, Stamford, Conn.

[21] Appl. No.: 94,403

[22] Filed: Nov. 15, 1979

[51] Int. Cl.[3] ..... B22F 3/00

[52] U.S. Cl. ..... 75/245; 75/176; 313/178; 313/179; 313/180

[58] Field of Search ..... 313/179, 178, 180; 75/176, 245

[56] References Cited

U.S. PATENT DOCUMENTS

| | | | |
|---|---|---|---|
| 3,590,197 | 6/1971 | Wesoloski | 75/176 |
| 3,644,773 | 2/1972 | Coaton et al. | 313/179 |
| 3,676,083 | 7/1972 | Cheney et al. | 75/176 |
| 3,748,519 | 7/1973 | Martin et al. | 313/179 |
| 3,983,440 | 9/1976 | Scott et al. | 313/179 |

*Primary Examiner*—Brooks H. Hunt

*Attorney, Agent, or Firm*—Robert E. Walter

[57] ABSTRACT

An alloy lead-in wire of molybdenum and tantalum which has gettering properties and a method of making the lead-in wire is described.

6 Claims, No Drawings

DOPED MOLYBDENUM-TANTALUM WIRE AND METHOD FOR MAKING

BACKGROUND OF THE INVENTION

The present invention relates to wires comprising molybdenum and tantalum which have utility for lighting applications and for electrical resistant heating wires.

The prior art discloses lead-in wires of molybdenum which are capable of being sealed within glass materials so as to prevent contamination of an envelope with air or other gases present in an operating atmosphere.

Gettering is a process by which the purity of a vacuum or the content of the envelope is maintained at a desired purity. Flash getters are employed as chemically active metals evaporated on the walls of a vacuum enclosure to provide a large area for reaction with a gas. Bulk getters are run hot but not flashed. Tantalum is disclosed in the prior art as a getter for lamps.

U.S. Pat. No. 3,748,519 to Martin et al. discloses a lead-in assembly having a molybdenum component and a tantalum gettering component attached to the lead-in assembly.

U.S. Pat. No. 3,676,083 to Cheney et al. discloses a molybdenum base alloy having a recrystallization temperature above that of molybdenum.

U.S. Pat. No. 3,644,773 to Coaton et al. relates to a hydrogen and halogen filled incandescent lamp having a hydrogen absorbing structure in the form of a getter flag comprising a piece of titanium coated with paladium. Tantalum is also disclosed as being used in place of titanium.

U.S. Pat. No. 3,983,440 to Scott et al. describes a structure in the form of a hollow carrier body of refractory metal in which a source of halogen, metal or metal halide is disposed and may be covered by a closure of refractory metal which may have gettering properties. The closure may be titanium, tantalum or zirconium or niobium.

When using alloy wires of molybdenum and tantalum in high temperature applications such as described above, it is desirable for the wires to retain the desired properties of high tensile strength and good ductility. However, it has been found that high temperature use, which results in recrystallization, decreases ductility which may cause mechanical failure.

It is an object of the present invention to provide a wire having favorable properties for use in prolonged high temperature applications.

Other and further objects will become apparent from reading the following description.

In accordance with the principles of the present invention, there is provided an alloy wire consisting essentially of molybdenum, tantalum and a sufficient amount of minor ingredients for maintaining favorable ductile and tensile strength properties after recrystallization, said minor ingredients and impurities being less than about one percent by weight.

There is also provided a method for producing an alloy wire consisting essentially of molybdenum, tantalum and minor ingredients comprising intimately mixing molybdenum powder, tantalum powder, and minor ingredients to form a uniform powder blend consisting essentially of molybdenum, tantalum, and a sufficient amount of minor ingredients for maintaining favorable tensile strength and ductility after recrystallization, said minor ingredients and impurities being less than about one percent by weight, forming a compacted article from said powder blend, sintering said powder blend for a sufficient time and at a sufficient temperature to form a resulting article, said sintering being carried out to such an extent wherein said article when cooled consist essentially of a single phase solid solution, working said article to form an alloy wire, and heating said wire for a sufficient period of time and at a sufficient temperature for recrystallizing said alloy.

DESCRIPTION OF PREFERRED EMBODIMENTS

The alloy wire of the present invention consists essentially of molybdenum and a sufficient amount of tantalum to impart gettering properties to the alloy or increase the electrical resistance of the alloy. Preferably the amount of tantalum is from about 2 to about 20 percent by weight. Due to the fact that molybdenum is more commercially available then tantalum, it is generally desirable to employ the least amount of tantalum that will impart the desirable properties. More preferably from about 2 to about 6 percent by weight tantalum is employed with the most preferable range being from about 3 to about 5 percent by weight. The tantalum should be present in an effective amount which imparts the desirable properties of gettering and electrical resistance.

The alloy wire typically has an electrical resistivity at about 0° C. of from about 5.20 to about 6.65 microhm—Cm. Preferably the electrical resistivity is less than about 5.64 microhm—cm and more preferably less than about 5.58 microhm—cm. The electrical resistivity of the alloy wire of the present invention enhances its use as an electrical resistance heating wire.

In addition to possessing gettering properties and desirable electrical resistivity, the alloy of the present invention possesses an additional property of suitable tensile strength which is maintained during prolonged high temperature use.

The favorable tensile strength properties contribute to the suitability for use as a wire component for halogen incandescent lamps. Lead-in wires (in sealing relationship with glass or quartz) typically pass through a lamp base. Inside the lamp envelope the lead wire or other wires may support a lamp filament which is typically a tungsten coil. The tungsten which is evaporated from the filament during operation combines with a halogen to form a gaseous halide. Such lamps are filled with an inert gas and a halogen additive. The lead wire or support wires which are typically attached to the tungsten coil should have sufficient tensile strength to permit its use over prolonged high temperature use.

The alloy wire of the present invention typically has a tensile strength in the unrecrystallized state of from about 30 to about 145 kilograms per square millimeter. More preferably the tensile strength in the unrecrystallized state is greater than about 52 kilograms per square millimeter and more preferably greater than about 70 kilograms per square millimeter in the unrecrystallized state. The relatively high tensile strength in the unrecrystallized state contributes to the use of the alloy wire for applications relating to halogen lamps and electrical resistant heating applications.

In accordance with the preferred embodiments of the present invention, the minor ingredients employed for maintaining favorable ductile and tensile strength properties after recrystallization comprising the addition of from about 50 to about 1000 parts per million of an alkali metal and from about 50 to about 1000 parts per million of silicon based on the total weight of the final alloy. It is preferred to use an alkali metal selected from the group consisting of sodium and potassium with potassium being especially preferred. It is preferred that the minor ingredients and impurities comprise less than about 5 parts per thousand parts of the finally alloy.

It has been found that with the addition of minor ingredients, the alloy wire of the present invention having a diameter greater than about 0.25 millimeters will not recrystallize below a temperature of about 1700° C. for a 15 second anneal while alloys without the minor ingredients will typically recrystallize substantially below a temperature of 1700° C. during a 15 second anneal. A typical 0.5 millimeter alloy wire without the minor ingredients will recrystallize after a 15 second anneal at about 1600° C., whereas typical 0.5 millimeter alloy wire with the minor ingredients will recrystallize after a 15 second anneal at about 1800° C. Such recrystallization of a typical molybdenum and tantalum alloy wire without the minor ingredients of the present invention, decreases the strength and hardness of the alloy wire. After a 15 second anneal at 1700° C. a typically 0.5 millimeter alloy wire with the minor ingredients will have a tensile strength of about 60 to 75 kilograms per square millimeter, and a typically 0.5 millimeter alloy wire without the minor ingredients will have a tensile strength after the same anneal of about 30 to 45 kilograms per square millimeter. The increase in recrystallization temperature has not been generally noticed until the alloys have been worked down to wire below about 2 millimeters in diameter.

It is to be noticed that the recrystallization temperature is dependent on the diameter of the wire with smaller diameters having higher recrystallization temperatures and larger diameters having lower recrystallization temperatures.

It is theorized that the severe metal working associated with the conventional techniques of forming wire by drawing, results in elongating sintering voids containing the minor ingredients. The elongated voids which may form along grain boundaries are broken into rows of small bubbles upon heating. The bubbles act as pinning sites which retard grain boundary migration and raise the recrystallization temperature of the wire. When these wires containing the dopants of the present invention, finally recrystallize at temperatures above those of the undoped molybdenum and tantalum alloy wire, the grain structure is an elongated interlocking structure which is ductile as composed to an equiaxed structure which is brittle for the undoped material.

For preferred use in electrical applications, the wire of the present invention preferably has a circular cross section with a diameter of from about 0.25 millimeters to about 0.81 millimiters. The wire size depends to some extent on the power rating of the device used with larger diameters being preferred for higher wattage devices.

The alloys of the present invention are prepared by powder metallurgical techniques wherein the component metallic powders are intimately mixed, compacted and sintered to the desired shape, worked and further reduced in size by wire drawing to obtain alloys having the desirable mechanical and electrical properties described above together with the desirable gettering properties. The alloys are prepared according to the above steps so that the final lead wire material comprises a substantially homogeneous distribution of tantalum and molybdenum. More preferably the resulting wire is a single phase solid solution of molybdenum, tantalum, and most of the minor ingredients hereinbefore described.

Although the dopants of the present invention can be added at a point prior to sintering, it is preferable to add either the metal salts or metal oxides to the molybdenum dioxide and then heat the mixture under a hydrogen atmosphere to convert the molybdenum oxide to molybdenum. For instance, potassium silicate which is both an alkali metal source and a silicon source is preferably incorporated into the molybdenum prior to reduction. When a metal salt or metal oxide is used, it should be one that will decompose to the appropriate alkali metal or silicon dopant.

The total amount of the dopant referred to herein is based on the total weight of the final alloy metal. The dopants may not remain in the molybdenum base alloy powder initially used but may be distilled from the matrix as the metallic oxide or as a volitile metal containing the compound. The amount of dopant employed is dependant on various factors such as the particular metal source used, the purity of the molybdenum source, the temperature and time of sintering. The amount of dopant employed in the presintered powder is at least equal to the weight amount desired in the final product and possibly up to about 10 times the amount.

The starting metallic molybdenum and tantalum powders which contain the minor ingredients employed are in substantially pure form having a particle size of from about 2 to about 10 microns. Any conventional technique can be used to intimately mix the powders together and the minor ingredients such as, for example, ball milling, or the like. After mixing the powders the mixture is compressed into a compact shape such as a rod or a bar.

The compacted article is sintered at an elevated temperature from about 1800° C. to about 2500° C. for a period of about 0.5 to about 4 hours in an inert atmosphere or vacuum. Sintering should take place for a sufficient period of time and at a sufficient temperature so as to result in the formation of a single phase solid solution of molybdenum, tantalum and most of the minor ingredient. The exact time for sintering may vary according to the temperature employed and the thickness of the compact with lower temperatures and thicker compacts requiring more time.

It has been found that alloys of the present invention which have been sintered to at least about 90, and more preferably to at least 95 percent of their theoretical density are sufficiently sintered to yield the single phase solid solution plus voids containing some of the minor ingredients.

The above formed sintered alloy having the desired shape is formed into wire by techniques known in the art. The ingot or rod may be swaged to a size suitable for subsequent wire drawing operations and annealed to improve the final properties.

EXAMPLE

A commercially available pure molybdenum powder having an average particle size of about 5.0 microns which is doped with about 600 ppm potassium and 900 parts per million silicon is blended with a commercially available pure tantalum powder having an average particle size of 9.0 microns. The powder was mixed in a blender for 1.0 hours and compacted at a pressure of about 26,000 psi to form a rod having cross section of 1 square inch and a length of 36 inches. The rod was sintered for about 1.5 hours at a temperature of about 2200° C. After sintering the rod was analyzed by spectographic techniques as containing about 97 percent molybdenum, 3 percent tantalum, 300 parts per million silicon and 100 parts per million potassium. The resulting rod was swaged in a rotary machine opening and closing a pair of dies to form a cylindrical rod having a diameter of about 0.2 inches and a length of about 90 feet.

The rod was then drawn through a series of dies until a diameter of about 0.013 inches was achieved. After annealing for about 2 seconds at a temperature of 1300° C., the wire was heated by electrical resistant heating to a temperature of about 2000° C. for a period of about one minute to recrystallize the alloy. The tensile strength and percent elongation measurements were made on an Instron tensile tester, Model TTCI, ASTM E-8577. It was found that the tensile strength of the recrystallized wire was about 30 kilograms per square millimeter with an elongation percent of 10. According to the above described procedure, an alloy wire without the above dopants was prepared. The tensile strength of the undoped wire was 35 kilograms per square millimeter and the elongation was 1, that is, very brittle.

A resistance heating of the alloy wire with the above dopants to a temperature of about 1700° C. for a period of about one minute would not recrystallize and would have measured tensile strength of about 65 kilograms per square millimeter with about 25 percent elongation. Whereas an alloy wire without the dopants would recrystallize and have measured tensile strength of about 40 kilograms per square millimeter and 3 percent elongation.

While there have been described various preferred embodiments of the present invention, it is apparent to one of ordinary skill in the art that variations and modifications may be made without departing from the spirit and scope of the invention as described in the appended claims.

We claim:

1. An alloy wire consisting essentially of a homogeneous composition of molybdenum, from about 2 to about 6 percent by weight tantalum, and a sufficient amount of minor ingredients for maintaining favorable tensile strength and ductility after recrystallization, said minor ingredients consisting of from about 50 to about 1000 parts per million by weight silicon and from about 50 to about 1000 parts per million by weight potassium, said minor ingredients and impurities being less than about five parts per thousand by weight, said wire being less than about 2 millimeters diameter.

2. An alloy wire according to claim 1 having an electrical resistivity at about 0° C. of from about 5.20 to about 6.65 microhm—cm.

3. An alloy wire according to claim 2 having a tensile strength of from about 30 to about 45 kilograms per square millimeter after recrystallization and excellent bend ductility after recrystallization.

4. An alloy wire according to claim 2 wherein said alloy lead wire has a substantially circular cross section and a diameter of from about 0.25 millimeters to about 0.81 millimeters.

5. An alloy wire according to claim 4 consisting essentially of a substantially homogeneous distribution of tantalum and molybdenum.

6. An alloy lead wire according to claim 5 consisting essentially of a single phase solid solution of molybdenum, tantalum and most of the said minor ingredients.

* * * * *